US011559984B2

(12) United States Patent
Amela Conesa et al.

(10) Patent No.: US 11,559,984 B2
(45) Date of Patent: Jan. 24, 2023

(54) INCREASING TEMPERATURES OF PRINTING ELEMENTS

(71) Applicant: Hewlett-Packard Development Company, L.P., Spring, TX (US)

(72) Inventors: Eduardo Amela Conesa, Sant Cugat del Valles (ES); Li Qian, Sant Cugat del Valles (ES); Marian Dinares Argemi, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 93 days.

(21) Appl. No.: 17/051,416

(22) PCT Filed: Jul. 13, 2018

(86) PCT No.: PCT/US2018/041969
§ 371 (c)(1),
(2) Date: Oct. 28, 2020

(87) PCT Pub. No.: WO2020/013843
PCT Pub. Date: Jan. 16, 2020

(65) Prior Publication Data

US 2021/0237433 A1 Aug. 5, 2021

(51) Int. Cl.
*B41J 2/045* (2006.01)
*B41J 2/195* (2006.01)

(52) U.S. Cl.
CPC ..... *B41J 2/04528* (2013.01); *B41J 2/0454* (2013.01); *B41J 2/04563* (2013.01); *B41J 2/195* (2013.01)

(58) Field of Classification Search
CPC ... B41J 2/04528; B41J 2/0454; B41J 2/04563
See application file for complete search history.

(56) References Cited

U.S. PATENT DOCUMENTS

| | | | |
|---|---|---|---|
| 4,791,435 | A | 12/1988 | Smith et al. |
| 5,475,405 | A | 12/1995 | Widder et al. |
| 6,513,895 | B2 | 2/2003 | Bauer et al. |
| 6,641,243 | B2 | 11/2003 | Anderson et al. |
| 7,306,758 | B2 | 12/2007 | Nielsen et al. |
| 7,758,147 | B2 | 7/2010 | Sheahan et al. |
| 8,087,757 | B2 | 1/2012 | Silverbrook |
| 8,305,411 | B1 | 11/2012 | Yamamoto |

(Continued)

FOREIGN PATENT DOCUMENTS

WO WO-2017019065 A1 * 2/2017 ..... B41J 2/04508

OTHER PUBLICATIONS

International Search Report and Written Opinion dated Mar. 21, 2019, PCT Patent Application No. PCT/US2018/041969, filed Jul. 13, 2018, Federal Institute of Industrial Property, Moscow, Russia, 7 pages.

*Primary Examiner* — Scott A Richmond

(57) ABSTRACT

A print apparatus is disclosed. The print apparatus comprises a plurality of printing elements; and a temperature control unit, controllable by processing circuitry, to increase an operating temperature of a first printing element in the plurality of printing elements by a defined amount relative to an operating temperature of a second printing element in the plurality of printing elements. A method and a machine-readable medium are also disclosed.

20 Claims, 5 Drawing Sheets

(56) References Cited

U.S. PATENT DOCUMENTS

| | | | | |
|---|---|---|---|---|
| 8,991,983 | B2 | 3/2015 | Hager et al. | |
| 2005/0270359 | A1* | 12/2005 | Katsuma | B41J 2/365<br>347/185 |
| 2006/0012625 | A1 | 1/2006 | Huang | |
| 2007/0216719 | A1 | 9/2007 | Ito | |
| 2014/0320563 | A1* | 10/2014 | Gracia Verdugo | B41J 2/0458<br>347/17 |

* cited by examiner

INCREASING TEMPERATURES OF PRINTING ELEMENTS

CLAIM FOR PRIORITY

The present application is a national stage filing under 35 U.S.C 371 of PCT application number PCT/US2018/041969, having an international filing date of Jul. 13, 2018, the disclosure of which is hereby incorporated by reference in its entirety.

BACKGROUND

A print agent distributor of a print apparatus may include a plurality of nozzles via which print agent is deposited onto a printable medium. The nozzles may be formed on a plurality of dies, each die housing a subset of the nozzles.

BRIEF DESCRIPTION OF DRAWINGS

Examples will now be described, by way of non-limiting example, with reference to the accompanying drawings, in which.

DETAILED DESCRIPTION

Figure 1:
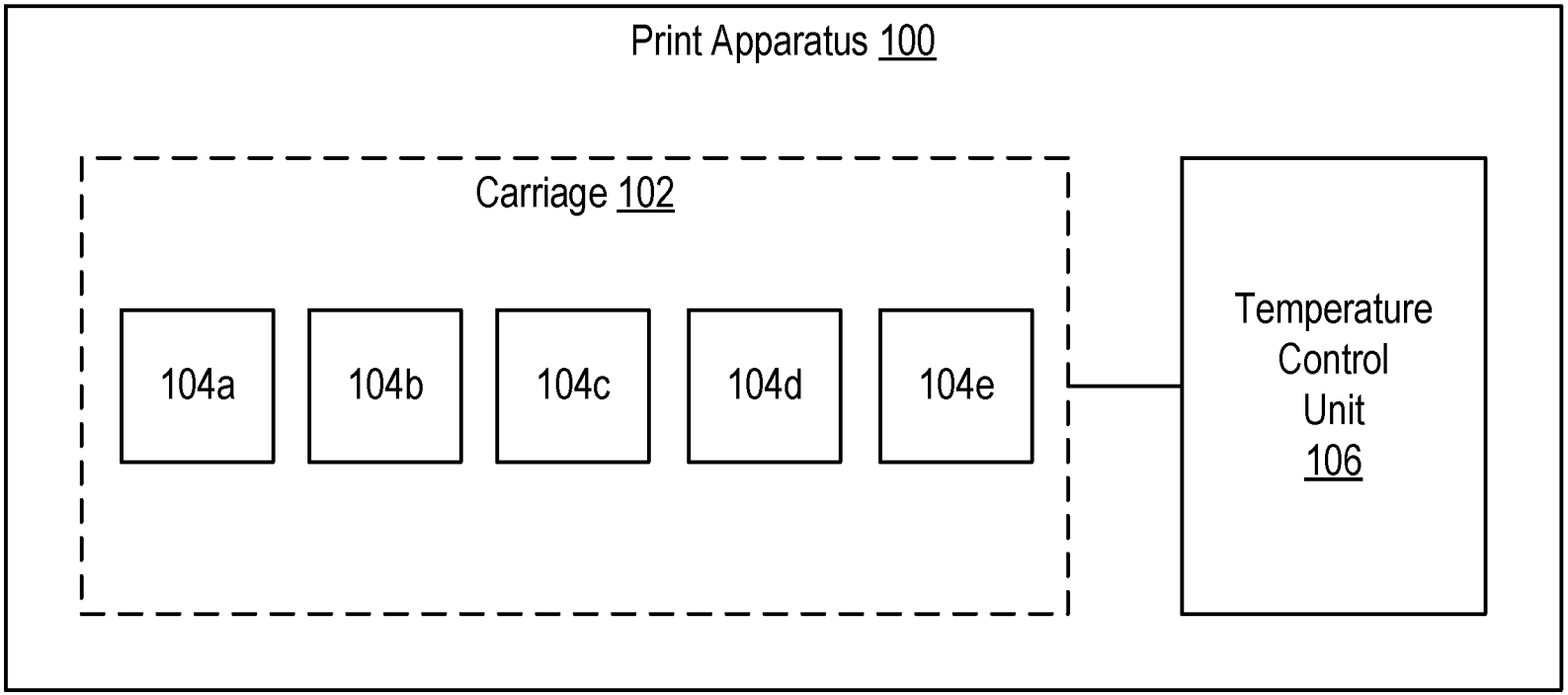
FIG. 1 is a simplified schematic of an example of an apparatus for increasing a temperature of a printing element.

The present disclosure relates to a mechanism by which a temperature of an individual printing element, such as a die, in a carriage of a print apparatus may be increased relative to another printing element in the carriage. In this way, the number and/or effect of print defects may be reduced, as will become apparent from the following discussion.

A print apparatus may include a print head for distributing print agent, or ink, onto a printable medium during a printing operation. In some examples, a print apparatus may include multiple print heads. For example, each print head may distribute print agent of a different colour. The print head or print heads may, in some examples, be mounted in or otherwise carried by a carriage. During a printing operation, the carriage may move or scan over a print target, such as a printable substrate, so that print agent may be deposited on to the print target. In other examples, the print head may extend over a full width of a printing area (e.g. the printable substrate) such that the print head does not scan over the width of the substrate. A print head may comprise a printing element, or a plurality of printing elements, each printing element housing a subset of nozzles. Nozzles are provided for distributing or depositing (e.g. through a spitting or firing procedure) print agent onto a print target (e.g. a printable medium or substrate, such as paper). In some examples, a printing element may comprise a die. Thus, a print head may comprise a plurality of dies. In other examples, a print head may comprise a single die. Thus, a carriage may, in some examples, carry a plurality of print heads, each print head comprising a single die.

In some print apparatuses, some dies may be used less than other dies. For example, a plurality of dies may be arranged across a width of a carriage or print head. In some examples, the dies towards the edge (e.g. those dies positioned at either side) of the carriage or print head may be used less during a printing operation than the dies towards the centre (e.g. those dies positioned more centrally) with respect to the carriage or print head. Such differential use levels of dies (and therefore nozzles) in a carriage or print head may be implemented in order to reduce the number and severity of printing defects which might otherwise occur. For example, effects resulting from issues regarding printable media advancement, or dynamic swath height errors may be reduced or avoided by reducing the usage of the edge dies relative to the more central dies. The reduced usage of some printing elements, or dies, may be achieved using, for example, a ramping strategy. For a ramping strategy, in the die or dies at the ends (e.g. at extremities) of the carriage or print head, nozzles nearest the edge of the carriage or print head are used the least (e.g. 0% usage), and nozzle usage progressively increased towards the centre of the print head (e.g. up to 100% usage). In other words, the usage ramps up from the end nozzles. In other examples, the reduced usage of some dies may be achieved using an interleaving strategy.

The strategy chosen (e.g. the printing elements selected for reduced usage) may be based on the printing mode of the print apparatus. For example, in a printing mode in which a large amount of print agent is to be deposited through nozzles of the dies, a ramping or interleaving strategy may be chosen which significantly reduces the usage of the dies at or towards the edge or edges of the carriage or print head.

A consequence of the reduced usage of some of the printing elements/dies is that those dies that are used less frequently do not age or wear at the same rate as the dies that are used to a greater extent. In other words, the dies having nozzles that are used less may not become worn as quickly as the dies having nozzles that are used the most. As such, printing defects may result from the differential wearing of the dies.

Aspects of the present disclosure provide a mechanism by which effects of the differential use of printing elements, or dies, in a carriage or print head may be mitigated or reduced.

An aspect of the present disclosure relates to an apparatus. FIG. 1 is a simplified schematic of an example of an apparatus 100. The apparatus 100 (e.g. a print apparatus) may be considered to be an apparatus for increasing a temperature of a printing element. The print apparatus 100 comprises a plurality of printing elements 104. In the example shown in FIG. 1, the print apparatus 100 includes five printing elements 104*a*, 104*b*, 104*c*, 104*d* and 104*e*. It will be appreciated, however, that, in other examples, more or fewer printing elements may be provided. The printing elements 104 may be arranged in or mounted in or on a carriage 102. In other examples, the printing elements may be for part of print agent distributor, also referred to as a print head. The carriage 102 is shown in FIG. 1 having dashed lines to indicate that it may be omitted. For example, the printing elements 104 may instead form part of a print head. A printing element may, in some examples, comprise a die, or printing die. Therefore, each printing element 104 may comprise a die. A die may, in some examples, be formed from a wafer of multiple dies. Thus, in some examples, a die may comprise a silicon die. Each printing element 104, or die, may comprise a nozzle, or multiple nozzles, by which print agent may be transferred onto a printable substrate. A printing element 104 may, for example, have hundreds or thousands of nozzles.

The print apparatus 100 also comprises a temperature control unit 106. The temperature control unit 106 may be controllable by processing circuitry (not shown in FIG. 1), such as a processor. In some examples, the processing circuitry may be included in, or form part of, the print apparatus 100. In other examples, the processing circuitry may comprise a separate, external component, located in a computing device, or forming part of a server arrangement, for example in a cloud-computing environment. The temperature control unit 106, controllable by the processing circuitry, is to increase an operating temperature of a first printing element in the by a defined amount relative to an operating temperature of a second printing element in the plurality of printing elements 104. In the example shown in FIG. 1, the temperature control unit 106 is in communication with the carriage 102. The temperature control unit 106 may, for example be in communication with a print head housing the printing elements 104. For example, the temperature control unit 106 may be electrically connected to the carriage 102, the print head and/the printing element(s) 104, and/or the temperature control unit may be capable of causing an operating temperature of the printing element(s) to change. The temperature control unit 106 may be in communication with some of the printing elements 104 such that the operating temperature of each printing element may be individually controlled. In a further example, the temperature control unit 106 is in communication with each of the printing elements 104.

For example, an operating temperature of printing elements 104 of a print apparatus 100 may be 45° C. (degrees Celsius). The operating temperature may be considered to be the temperature at which nozzles and/or printing elements 104 are intended to reach in order to perform a printing operation (e.g. depositing print agent onto a substrate). For example, the operating temperature may be considered to be a minimum temperature at which the printing element 104 is intended to operate. According to the present disclosure, the operating temperature of one of the printing elements (or more than one of the printing elements) 104 is increased to a temperature higher than the operating temperature of another of the printing elements, in order to intentionally create a temperature difference between printing elements within a carriage 102 or print head. The temperature control unit 106 may, for example, increase the operating temperature of one the printing elements 104, or more than one of the printing elements, to 55° C. It will be appreciated that the operating temperature of a printing element 104 and/or of a nozzle may depend on the nature and/or type of printer apparatus in which the printing element is to be used and/or on other factors, such as a printing mode used to perform a printing operation. A printing mode may be considered to comprise a set of parameters of the print apparatus 100 to be used when performing a particular printing operation. For example, in a "draft" printing mode, less print agent may be deposited through fewer nozzles of each printing element 104 than when a "best" printing mode is selected.

By increasing the operating temperature of a printing element 104 or printing elements relative to other printing elements, the printing element(s) whose operating temperature is increased may be caused to function or behave differently from those printing elements operating at a relatively lower temperature. In some examples, the operating temperature of a printing element 104 may be increased relative to the operating temperature of another printing element in order to increase the effects of ageing the printing element. For example, in a print head or carriage 102 in which some printing elements 104 are used less than other printing elements, the operating temperature of those less-used printing elements may be increased relative to the operating temperature of the printing elements which are used to a greater extent. In this way, the effects of using some of the printing elements to a greater extent may be replicated, or emulated in the less-used printing elements by increasing their operating temperature.

Increasing the operating temperature of the less-used printing elements can help to achieve a more uniform aging of the printing elements, thereby improving consistency in print quality. The operating temperature of the printing elements that are used the most for depositing print agent onto a printable substrate during a printing operation will increase more than the temperature of those printing elements that are used less frequently. A higher temperature may affect characteristics of the print agent deposited via the printing element. For example, a change in temperature may affect the drop weight and/or drop velocity of print agent. Using the temperature control unit 106 to increase the temperature of the less-used printing elements 104 may cause the print agent associated with those printing elements to behave similarly to the print agent associated with the more frequently-used printing elements. As a result, a more consistent print quality can be achieved.

The temperature control unit 106 may comprise any unit suitable for increasing an operating temperature of a printing element 104 relative to the operating temperature of another printing element. A print head or carriage 102 may comprise electrical components (e.g. resistors, capacitors and the like) which are used to determine which nozzles in a printing element 104 are to deposit print agent onto a printable substrate. In some examples, the temperature control unit 106 may increase the operating temperature of a printing element 104 by increasing a current flowing through a particular electrical component associated with the printing element whose operating temperature is to be increased. In other words, a printing element may be controlled to cause an increase in its operating temperature. In an example, by increasing the current flowing through particular electrical components by a defined amount, it may be possible to increase the operating temperature of a particular printing element 104 by a defined temperature.

Figure 2:
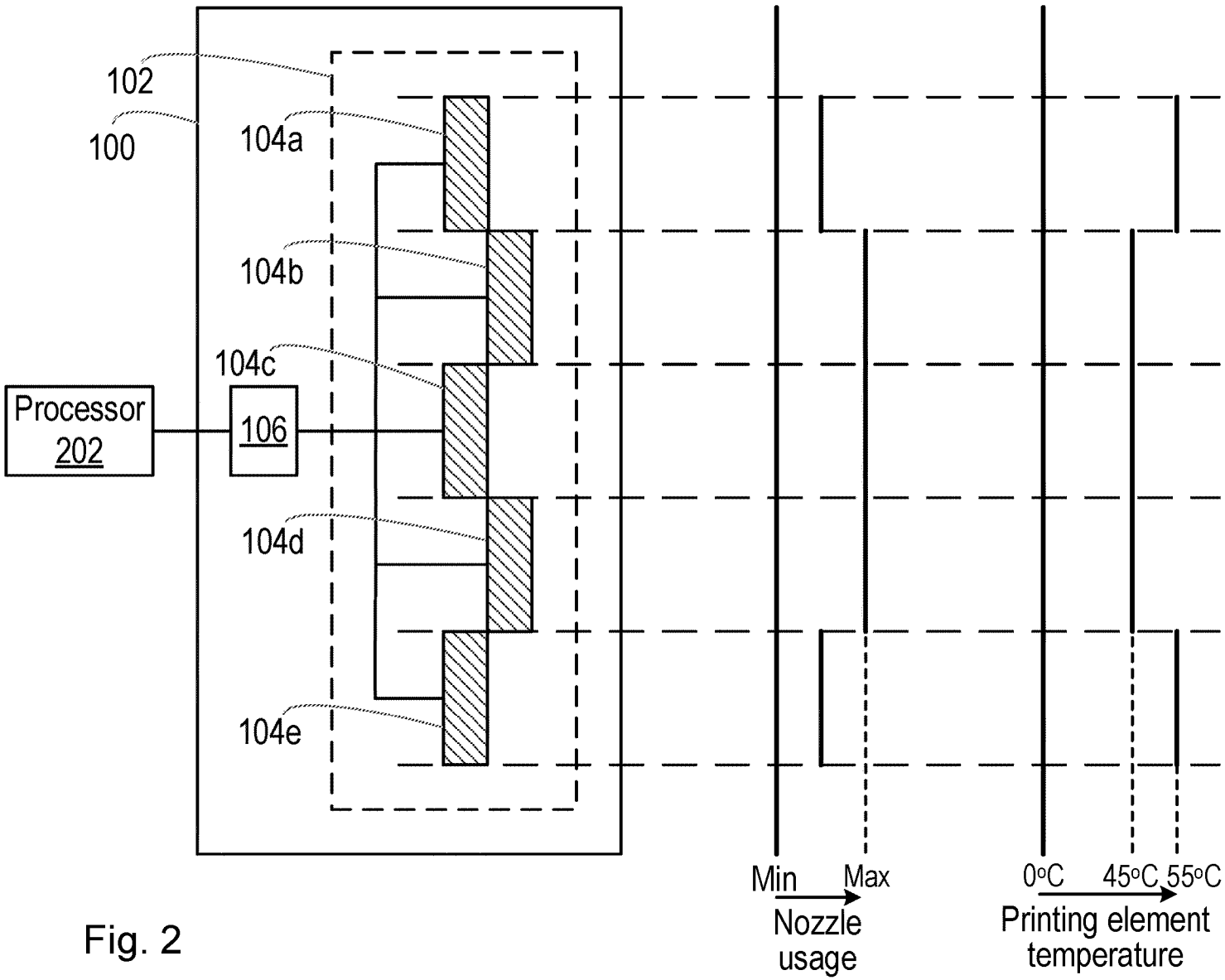
FIG. 2 is a simplified schematic of an example of an apparatus for increasing a temperature of a printing element and an indication of example usage and temperatures of printing elements.

FIG. 2 is a simplified schematic of the print apparatus 100 and an indication of the usage and operating temperature of the printing elements 104. In FIG. 2, the print apparatus 100 includes a plurality of printing elements 104, and the temperature control unit 106. The plurality of printing elements 104 may form part of a carriage 102 or a print head, as discussed above. A processor 202 is in communication with the temperature control unit 106. While, in FIG. 2, the processor 202 is shown to be external from the print apparatus 100, as noted above, the processor 202 (or processing circuitry) may, in some examples, be located in (e.g. form part of) the print apparatus. For example, the processor 202 may comprise a processor of the print apparatus 100 which is used for performing other processing activities.

In the example of FIG. 2, the print apparatus 100 includes five printing elements 104*a*, 104*b*, 104*c*, 104*d* and 104*e*. As noted above, however, the print apparatus may, in other examples, comprise more or fewer printing elements. The printing elements 104, in the example of FIG. 2, are arranged substantially linearly across a width of the carriage 102. In other examples, the printing elements 104 may be arranged substantially linearly across a width of a print head. Thus, the printing element 104*a* is located at one end of the printing element arrangement, near to a first side 102*a* of the carriage 102 (or print head), and the printing element 104*e* is located at an opposite end of the printing element arrangement, near to a second side 102*b* of the carriage (or print head). The printing elements 104*b*, 104*c* and 104*d* are arranged substantially linearly between the printing elements 104*a* and 104*e*. Each of the printing elements 104 may be individually coupled to or in communication with the temperature control unit 106 such that an operating temperature of any printing element may be independently controlled relative to the operating temperature of any other printing element in the carriage 102 (or print head).

As discussed above, the printing elements towards the sides or edges of a carriage 102 or print head (e.g. the printing elements 104*a* and 104*e*) may, in some examples, be used less than the printing elements located nearer to the centre of the carriage or print head (e.g. the printing elements 104*b*, 104*c*, 104*d*). This may help to reduce the occurrence of printing defects. This differential usage is depicted in FIG. 2 by a chart 204 showing relative usage of the printing elements 104. The chart 204 shows an example wherein the printing elements 104*b*, 104*c*, 104*d* are used to a greater extent than the printing elements 104*a* and 104*e* towards the ends of the printing element arrangement.

Over time, using some printing elements 104 less than other printing elements may lead to the occurrence of other printing defects, for example resulting from the differential wearing (e.g. ageing) of the printing elements. For example, those printing elements 104*b*, 104*c*, 104*d* that are located more centrally in the carriage 102 or print head and, therefore, are used to a greater extent, may experience increased wear with respect to those printing elements 104*a* and 104*e* that are located near to the sides of the carriage 102 or print head, which are therefore used to a lesser extent. Therefore, to compensate for the differential wear, the operating temperature of the printing elements 104*a* and 104*e* near to the sides of the carriage 102 may be increased, using the temperature control unit 106, relative to the operating temperature of the printing elements 104*b*, 104*c* and 104*d*. An example of differential heating is depicted in FIG. 2 by a chart 206 showing relative operating temperatures of the printing elements 104. The chart 206 shows an example in which the printing elements 104*a* and 104*e* have an operating temperature higher than the operating temperature of the printing elements 104*b*, 104*c* and 104*d*. In one example, the operating temperature of the printing elements 104*b*, 104*c* and 104*d* may be around 45 ° C., and the temperature control unit 106 may cause the operating temperature of the printing elements 104*a* and 104*e* to be over 45° C., e.g., around 55° C. In other examples, the operating temperatures of the printing elements 104 may be different.

Thus, the plurality of printing elements 104 may be distributed over a width of the carriage 102. In some examples, the plurality of printing elements 104 may be distributed over the entire width of the carriage 102 while, in other examples, the plurality of printing elements may be distributed of part of the carriage. The first printing element (e.g. 104*a*) may be located closer to an edge of the carriage 102 than the second printing element (e.g. 104*c*). As noted above, the plurality of printing elements 104 may, in some examples, be formed in a substantially linear arrangement over a width of the carriage 102. The first printing element (e.g. 104*a*) may be located at an extremity of the arrangement. While the temperature control unit 106 may function to increase an operating temperature of just the first printing element, it will be apparent that, in some examples, the temperature control unit may function to increase an operating temperature of multiple printing elements in the carriage. For example, the temperature control unit 106 may be further to increase an operating temperature of a printing element (e.g. 104*e*) at the other extremity of the arrangement.

In the example discussed above, the operating temperature of a single printing element 104 at each end of the printing element arrangement is increased relative to the other printing elements. In some examples, however, the operating temperatures of different printing elements 104 may be increased by different amounts. For example, in the printing element arrangement shown in FIG. 2, the centrally located printing element 104*c* may be used the most in printing operations, and the printing elements 104*a* and 104*e* may be used the least in printing operations. The printing elements 104*b* and 104*d* may be more than the printing elements 104*a* and 104*e*, but less than the printing element 104*c*. To compensate for the differential usage in this example, the operating temperature of the printing elements 104*b* and 104*d* may be increased by a first amount (e.g. to a temperature of around 50° C.), and the operating temperature of the printing elements 104*a* and 104*e* may be increased by a second amount (e.g. to a temperature of around 55° C.), greater than the first amount. Put another way, the temperature control unit 106 may be to increase an operating temperature of the first printing element (e.g. 104*a*) by a first defined amount relative to an operating temperature of the second printing element (e.g. 104*c*). The temperature control unit 106 may be to increase an operating temperature of a third printing element (e.g. 104*b*) of the plurality of printing elements by a second defined amount relative to an operating temperature of the second printing element (e.g. 104*c*). In this way, the wear of different printing elements 104 can accurately and effectively be compensated for.

Various techniques for increasing operating temperature of a printing element 104 are described in the foregoing as examples. In some examples, the temperature control unit 106 may be to increase an operating temperature of the first printing element by applying a trickle warming technique or a pulse warming technique. For example, a pulse warming technique may be used in which short pulses of electrical energy are supplied to an electrical component (e.g. a resistor) corresponding to a nozzle, a group of nozzles or a printing element whose temperature is to be increased. The pulse of electrical energy is intended to be sufficient (e.g. long enough) to increase the temperature of the electrical component (and associated print agent), but not sufficient (e.g. not long enough) to cause firing of the print agent.

The printing element operating temperatures mentioned above are merely illustrative examples of the types of operating temperatures that might be used for printing elements. More generally, the temperature control unit 106 may be to increase an operating temperature of the first printing element by between around 5° C. and around 20° C. relative to (e.g. above) the operating temperature of the second printing element. In other words, the temperature control unit 106 may cause the operating temperature of the first printing element to increase to between around 5° C. and 20° C. above the operating temperature of the second printing element.

Figure 3:
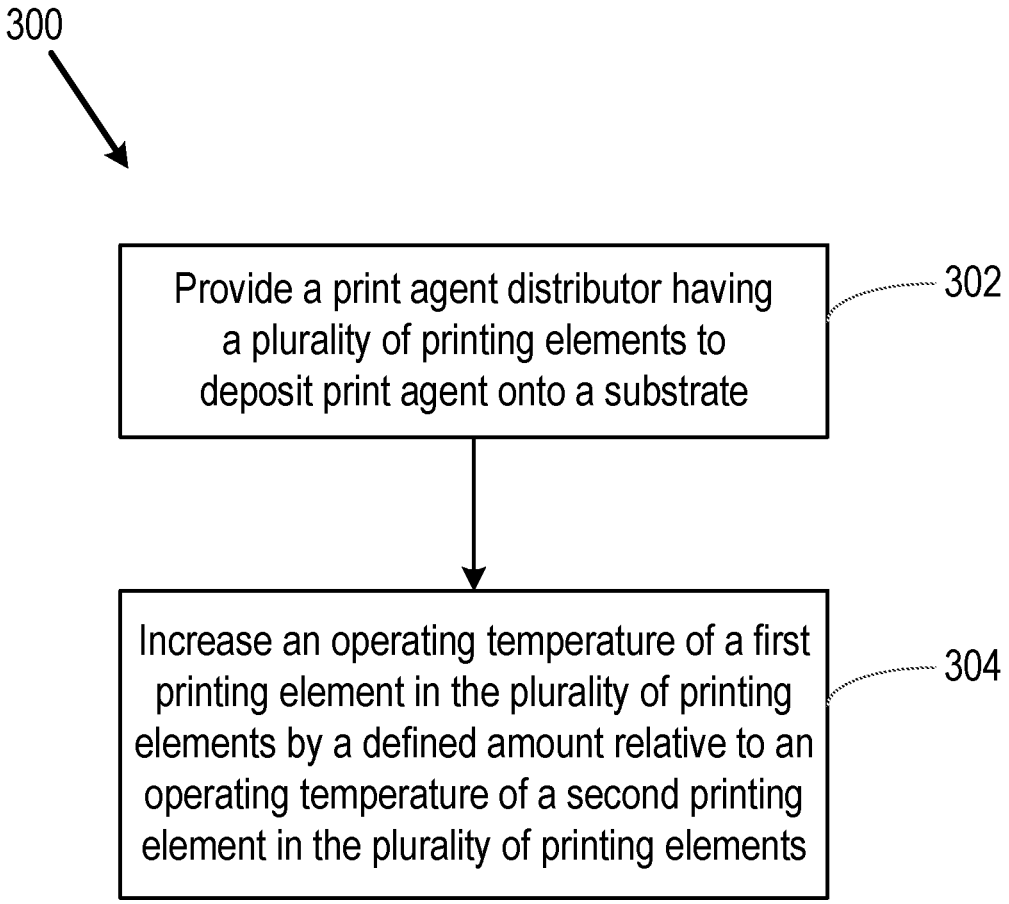
FIG. 3 is a flowchart of an example of a method of increasing a temperature of a printing element.

A further aspect of the present disclosure relates to a method. FIG. 3 is a flowchart of an example of a method 300 for increasing a temperature of a printing element (e.g. a printing element 104 of the plurality of printing elements). The method 300 comprises, at block 302, providing a plurality of printing elements to deposit print agent onto a substrate. The printing elements may be arranged, formed or mounted in or on a carriage which may comprise or be similar to the carriage 102 discussed herein. In some examples, the printing elements 104 may be arranged, formed or mounted in or on a print head. The printing elements of block 302 may comprise printing elements 104 discussed herein. At block 304, the method 300 further comprises increasing operating temperature of a first printing element in the plurality of printing elements by a defined amount relative to an operating temperature of a second printing element in the plurality of printing elements. As in the example discussed above, the first printing element may, in some examples, comprise the printing element 104*a* or 104*e*, and the second printing element may comprise one of the printing elements 104*b*, 104*c* or 104*d*.

Figure 4:
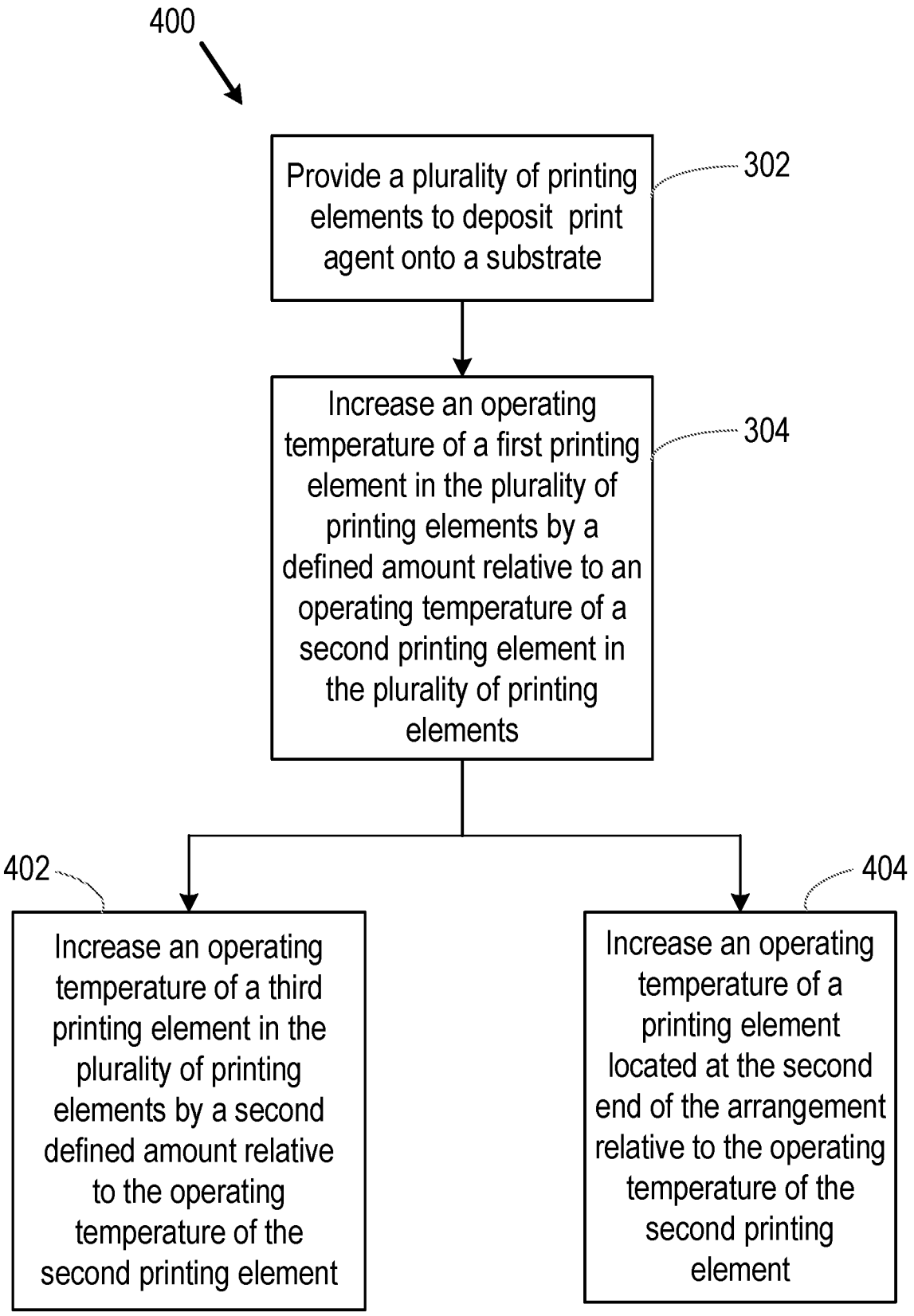
FIG. 4 is a flowchart of a further example of a method of increasing a temperature of a printing element.

FIG. 4 is a flowchart of a further example of the method 400 for increasing temperature of a printing element. The method 400 may comprise blocks of the method 300 discussed above. According to some examples, the increasing (block 304) may comprise increasing the temperature of the first printing element by a first defined amount relative to an operating temperature of the second printing element. The method 400 may further comprise, at block 402, increasing an operating temperature of a third printing element in the plurality of printing elements by a second defined amount relative to the operating temperature of the second printing element. Thus, the method 400 may comprise adjusting the temperatures of different printing elements by different amounts. This may be done, for example, when the use of printing elements 104 in the carriage 102 is varied according to a ramp strategy, whereby printing elements towards the edges of the carriage 102 are used least, and the usage of the printing elements increases in a smooth or incremental-manner (e.g. ramping up) towards the centre of the carriage.

Increasing an operating temperature of the first printing element may, in some examples, comprise applying a trickle warming technique or a pulse warming technique.

As in the example shown in FIG. 2, the first printing element may be located closer to an edge of the carriage than the second printing element. Thus, the first printing element may comprise the printing element 102*a* and the second printing element may comprise the printing element 102*c*. In some implementations, such as the implementation shown in FIG. 2, the plurality of printing elements may be formed in a substantially linear arrangement having a first end and a second end. For example, the substantially linear arrangement of printing elements 104 may extend across the width of the carriage 102. The first printing element (e.g. 104*a*) may be located at a first end of the arrangement. The method 400 may further comprise, at block 404, increasing an operating temperature of a printing element located at the second end of the arrangement relative to the operating temperature of the second printing element. Thus, in the example shown in FIG. 2, the printing element 104*e* may be considered to be located at the second end of the arrangement.

Figure 5:
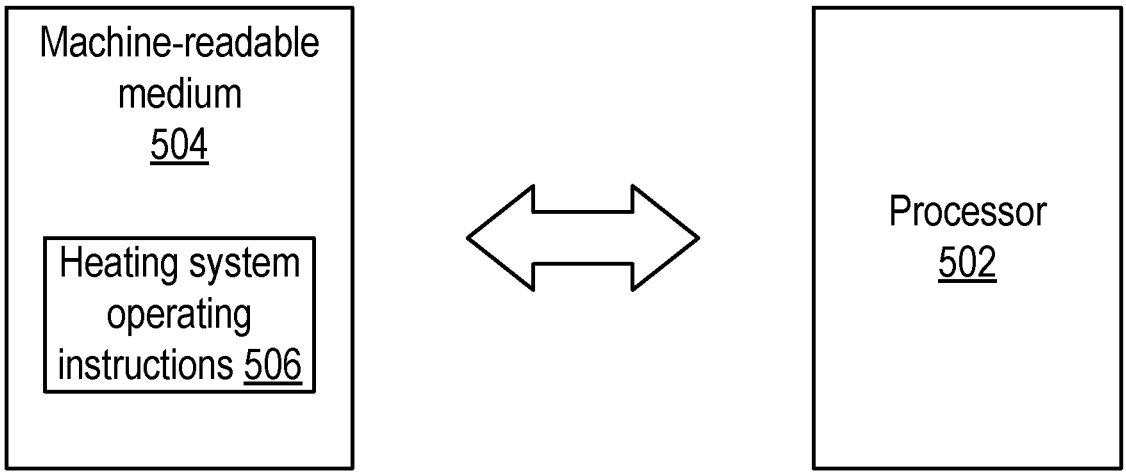
FIG. 5 is a simplified schematic of an example of a machine-readable medium and a processor.

A further aspect of the present disclosure relates to a machine-readable medium. FIG. 5 is a simplified schematic of a processor 502 and a machine-readable medium 504. The machine-readable medium 504 comprises instructions which, when executed by the processor 502, cause the processor to operate a heating system to increase an operating temperature of a first subset of printing elements in a plurality of printing elements by a first defined amount relative to an operating temperature of a second subset of printing elements of the plurality of printing elements. The heating system may comprise or be similar to the temperature control unit 106 discussed herein. The plurality of printing elements may comprise or be similar to the plurality of printing elements, or dies, 104. A subset of printing elements may comprise any number of printing elements smaller than the total number of printing elements in the plurality of printing elements. For example, a subset of printing elements may comprise a single printing element or multiple printing elements. In some examples, the machine-readable medium 504 may comprise heating system operating instructions 506 to be executed by the processor 502.

In some examples, the machine-readable medium 504 may comprise instructions (e.g. further heating system operating instructions) which, when executed by the processor 502, cause the processor to increase an operating temperature of a third subset printing elements of the plurality of printing elements by a second defined amount relative to an operating temperature of the second subset of printing elements. Thus, the processor 502 may operate the heating system to increase different subsets of printing elements 104 by different amounts, so as to compensate for different degrees of usage.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine-readable instructions may, for example, be executed by a general purpose computer, a special purpose computer, an embedded processor or processors of other programmable data processing devices to realize the functions described in the description and diagrams. In particular, a processor or processing apparatus may execute the machine-readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine-readable instructions may also be stored in a computer readable storage that can guide the computer or other programmable data processing devices to operate in a specific mode.

Such machine-readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print apparatus comprising:

a plurality of printing elements; and a temperature control unit, controllable by processing circuitry, to increase an operating temperature of a first printing element in the plurality of printing elements by a defined amount relative to an operating temperature of a second printing element in the plurality of printing elements, wherein the first printing element functions differently than the second printing element based on the increased operating temperature of the first printing element.

2. A print apparatus according to claim 1, wherein the plurality of printing elements are distributed over a width of a carriage to carry the printing elements; and wherein the first printing element is located closer to an edge of the carriage than the second printing element.

3. A print apparatus according to claim 1, wherein the plurality of printing elements are formed in a substantially linear arrangement over a width of a carriage to carry the printing elements; and wherein the first printing element is located at an extremity of the arrangement.

4. A print apparatus according to claim 3, wherein the temperature control unit is further to increase an operating temperature of a printing element at the other extremity of the arrangement.

5. A print apparatus according to claim 1, wherein the temperature control unit is to increase an operating temperature of the first printing element by a first defined amount relative to an operating temperature of the second printing element; and wherein the temperature control unit is to increase an operating temperature of a third printing element of the plurality of printing elements by a second defined amount relative to an operating temperature of the second printing element.

6. A print apparatus according to claim 1, wherein the temperature control unit is to increase an operating temperature of the first printing element by applying a trickle warming technique or a pulse warming technique.

7. A print apparatus according to claim 1, wherein the temperature control unit is to increase an operating temperature of the first printing element by between around 5° C. and around 20° C. relative to the operating temperature of the second printing element.

8. A print apparatus according to claim 1, wherein each printing element comprises a die.

9. The print apparatus according to claim 1, wherein the first printing element is less-used than the second printing element, and increasing the operating temperature of the first printing element provides a more uniform aging of the first printing element relative to the second printing element.

10. The print apparatus according to claim 9, wherein the providing a more uniform aging improves consistency in print quality between the first printing element and the second printing element.

11. A method comprising:

providing a plurality of printing elements to deposit print agent onto a substrate; and increasing an operating temperature of a first printing element in the plurality of printing elements by a defined amount relative to an operating temperature of a second printing element in the plurality of printing elements, wherein the first printing element functions differently than the second printing element based on the increased operating temperature of the first printing element.

12. A method according to claim 11, wherein said increasing comprises increasing the temperature of the first printing element by a first defined amount relative to an operating temperature of the second printing element, the method further comprising:

increasing an operating temperature of a third printing element in the plurality of printing elements by a second defined amount relative to the operating temperature of the second printing element.

13. A method according to claim 11, wherein increasing an operating temperature of the first printing element comprises applying a trickle warming technique or a pulse warming technique.

14. A method according to claim 11, wherein the plurality of printing elements are carried by a carriage; and wherein the first printing element is located closer to an edge of the carriage than the second printing element.

15. A method according to claim 11, wherein the plurality of printing elements are formed in a substantially linear arrangement having a first end and a second end, and wherein the first printing element is located at a first end of the arrangement, the method further comprising:

increasing an operating temperature of a printing element located at the second end of the arrangement relative to the operating temperature of the second printing element.

16. The method according to claim 11, wherein the first printing element is less-used than the second printing element, and the increasing the operating temperature of the first printing element provides a more uniform aging of the first printing element relative to the second printing element.

17. A method according to claim 16, wherein providing a more uniform aging improves consistency in print quality between the first printing element and the second printing element.

18. A machine-readable medium comprising instructions which, when executed by a processor, cause the processor to:

operate a heating system to increase an operating temperature of a first subset of printing elements in a plurality of printing elements by a first defined amount relative to an operating temperature of a second subset of printing elements of the plurality of printing elements, wherein the first subset of printing elements function differently than the second subset of printing elements based on the increased operating temperature of the first subset of printing elements.

19. A machine-readable medium according to claim 18, comprising instructions which, when executed by a processor, cause the processor to:

operate the heating system to increase an operating temperature of a third subset printing elements of the plurality of printing elements by a second defined amount relative to an operating temperature of the second subset of printing elements.

20. A machine-readable medium according to claim 18, wherein the first subset of printing elements are less-used than the second subset of printing elements, and the increasing the operating temperature of the first subset of printing elements provides a more uniform aging of the first subset of printing elements relative to the second subset of printing elements to improve consistency in print quality between the first subset of printing elements and the second subset of printing elements.

* * * * *